US006086183A

United States Patent [19]

Nakahara

[11] Patent Number: 6,086,183

[45] Date of Patent: Jul. 11, 2000

[54] RECOVERY DEVICE OF AN INK JET PRINTER

[75] Inventor: Junji Nakahara, Nagoya, Japan

[73] Assignee: Brother Kogyo Kabushiki Kaisha, Nagoya, Japan

[21] Appl. No.: 09/036,674

[22] Filed: Mar. 9, 1998

[30] Foreign Application Priority Data

Mar. 13, 1997 [JP] Japan ..... 9-058670

[51] Int. Cl.[7] ..... B41J 2/165

[52] U.S. Cl. ..... 347/30

[58] Field of Search ..... 347/30, 23, 29

[56] References Cited

U.S. PATENT DOCUMENTS

| | | | |
|---|---|---|---|
| 5,543,826 | 8/1996 | Kuronuma et al. | 347/23 |
| 5,606,353 | 2/1997 | Mochizuki et al. . | |
| 5,639,220 | 6/1997 | Hayakawa | 417/53 |
| 5,926,193 | 7/1999 | Umeda | 347/30 |
| 5,934,889 | 8/1999 | Muraki | 417/488 |

*Primary Examiner*—N. Le
*Assistant Examiner*—Shih-wen Hsieh
*Attorney, Agent, or Firm*—Oliff & Berridge, PLC

[57] ABSTRACT

A suction pump 42 includes a casing 52 and a pair of piston members 53, 54. The casing 52 has a suction port 52*a* connected to a suction cap 41 via a channel 55 and a discharge port 52*b* for discharging ink sucked in through the suction port 52*a*. The pair of piston members 53, 54 are independently movable within the casing 52 and define between themselves a pump chamber 52*e* having a volume changeable with relative position of the piston members 53, 54. First, the piston members 53, 54 are driven to increase the volume of the pump chamber 52*e* so that ink from a recording head in sealing connection with the suction cap fills the suction cap and the channel. Then while maintaining the ink in the suction cap 41 and the channel 55, the piston member 53, 54 are driven to reduce the size of the pump chamber 52*e* to a minimum to discharge the ink from the pump chamber 52*e*. Then the piston members 53, 54 are driven to increase the volume of the pump chamber 52*e* from the minimum volume at a predetermined stroke in order to suck a predetermined amount of ink from the recording head.

14 Claims, 8 Drawing Sheets

FIRST SUCTION OPERATION

FIRST DISCHARGE OPERATION

FIRST SUCTION OPERATION

SECOND DISCHARGE OPERATION

RECOVERY DEVICE OF AN INK JET PRINTER

BACKGROUND OF THE INVENTION

1. Field of the Invention

The present invention relates to a recovery device for sucking ink from an ink jet recording head of an ink jet printer in order to return the recording head to a proper ejecting condition.

2. Description of the Related Art

Ink jet printers include a recording head formed with nozzles for ejecting ink droplets onto a recording medium and a recovery unit for correcting defective ejection of ink from the recording head. The recovery unit includes a suction cap and a suction pump in fluid communication with each other. To return the recording head to a proper ejecting condition, the suction cap is brought into sealing contact with the recording head and the suction pump is operated to suck ink from the nozzles of the recording head through the suction cap.

SUMMARY OF THE INVENTION

When the suction cap is first brought into contact with the recording head, air fills the suction cap and a channel connecting the suction cap to the suction pump. From this condition, the suction pump is operated to draw ink from the recording head into the suction pump. Therefore, the suction pump must have a suction force sufficient to draw ink from the recording head to the suction pump. When the recording head is separated from the suction pump by a relatively long distance, a relatively large suction pump is required to transport the ink the entire distance. Further, the recovery unit is inefficient because a certain portion of the pump is used solely for filling the suction cap and the channel between the suction cap and the suction pump, and not for sucking ink from the recording head into the suction pump.

It is an objective of the present invention to overcome the above-described problems and to provide a recovery unit for an ink jet printer with excellent efficiency.

In order to achieve these objectives, a recovery unit according to the present invention includes a suction cap capable of covering a nozzle surface of a recording head of a printer; a suction pump connected to the suction cap and that sucks, through the suction cap, ink from the nozzles formed in the nozzle surface; and a suction control unit. The suction control unit controls the suction pump to sequentially perform a first ink suction operation, a first discharge operation, a second ink suction operation, and a second discharge operation, wherein the second ink suction operation generates a greater negative pressure than the first ink suction operation.

With this configuration, during the first suction operation the suction pump sucks a small amount of ink out of the recording head. This small amount of ink will replace air filling at least a portion of the suction cap. During the first discharge operation, at least a portion of any ink actually sucked into the suction pump will be discharged from the suction pump. Then, ink is sucked from the recording head and discharged from the suction pump during the second suction and discharge operations at a greater force than during the first suction and discharge operations.

Because the first suction operation fills at least a portion of the suction cap with ink, the burden on the suction pump will be reduced by that amount during the second suction operation so that the suction pump is more efficient. Further, because the air and any ink sucked into the suction pump during the first suction operation is discharged during the first discharge operation, more of the stroke of the suction pump can be used for producing a large negative pressure for vigorously sucking ink from the recording head during the second suction operation. This enables producing the suction pump, and consequently the recovery unit, in a smaller size. Also, because the first suction operation generates a smaller negative pressure than the second suction operation, ink will be gently introduced into the recording head and the suction cap. Were ink introduced into the recording head with great force using a large negative pressure during the first suction operation, the ink might froth up in the recording head. Therefore, the present invention prevents air bubbles from forming in the ink of the recording head.

According to another aspect of the present invention, the control unit controls so that the first suction operation draws ink from the recording head to completely fill the suction cap and a channel connecting the suction cap with the suction pump. Because the first suction operation fills both the suction cap and the channel connecting the suction cap and the suction pump so that no air fills the suction cap or the channel, the force generated during the second suction and discharge operations can be totally used to suck and discharge ink from the recording head. Therefore, suction force generated during the second suction and discharge operations can be more efficiently utilized. Compared to a situation wherein all suction and discharge, including suction of ink into the cap and channel, are performed in a single suction and discharge operation, the stroke of the pump can be reduced so that the pump can be made in a smaller size.

The suction pump can be provided with two piston members disposed in a pump casing. With this configuration, suction and discharge can be performed by changing volume of a pump chamber defined between the piston members. During the first suction operation, the piston members are controlled to develop only a small negative pressure in the pump chamber. Then, during the second suction operation, the piston members are controlled to greatly increase the volume of the pump chamber so that a large negative pressure is generated in the pump chamber. As a result, the first and second suction and discharge operations can be performed by controlling the suction pump with a simple control method. Further, the stroke of the piston member can be reduced so that the size of the entire pump can be reduced.

According to another aspect of the present invention, the control unit controls to reduce volume of the pump chamber to a minimum after the first suction and discharge operations have been completed. With this configuration, the maximum negative pressure possible can generated during the second suction operation by relative movement of the piston members. Further, as long as the suction pump has sufficient stroke for performing the second suction and discharge operations, the pump can be produced in a relatively small size and still have sufficient stroke for removing air from ejection channels of the recording head, the suction cap, and the channel, which connects the recording head and the suction pump, during the first suction and discharge operations and also for the second suction and discharge operations.

According to another aspect of the present invention, a recovery unit includes a suction cap capable of sealingly covering a nozzle surface of a recording head; a suction pump in fluid communication with the suction cap through a channel, the suction pump having a variable volume pump chamber that enables the suction pump to suck ink from the nozzles through the suction cap; and a suction control unit. The suction control unit controls the suction pump to sequentially bring the suction cap into sealed contact with the nozzle surface of the recording head; increase volume of the pump chamber a first time to draw ink into the suction cap and the channel; decrease volume of the pump chamber while maintaining ink in the suction cap and the channel; and increase volume of the pump chamber a second time to suck ink from the nozzles, the suction cap, and the channel.

With this configuration, air in the suction cap and the channel is sucked out and discharged by the suction pump when the volume of the pump chamber is first increased and decreased. When the volume of the pump chamber is again increased sequentially afterward to perform a suction operation in order to purge foreign matter from the recording head, this suction operation can be performed while ink fills the suction cap and the channel between the suction cap and the suction pump. Therefore, ink can be efficiently sucked out of the recording head. Accordingly, the amount of movement required for the pump to suck and discharge a predetermined amount of ink can be reduced so that the size of the pump can be reduced.

According to still another aspect of the present invention, a recovery unit includes a suction cap capable of sealingly covering a nozzle surface of a recording head; a suction pump in fluid communication with the suction cap, the suction pump; and a disk-shaped cam member rotatable about an axis and formed with grooves that surround the axis. The suction pump has a cylindrical pump casing having a suction port in fluid communication with the suction cap and a discharge port; and a first and second piston members slidably disposed in the cylindrical pump casing so as to define therebetween a pump chamber with volume that varies with relative position of the first and second piston members. The first and second piston members are engaged in the grooves of the cam member.

The grooves of the cam member are shaped so that a single rotation of the cam member drives and controls the first and second piston members to sequentially perform a first suction operation for sucking, through the suction port, air from the suction cap and ink from the print head;

a first discharge operation for discharging, through the discharge port, at least air sucked during the first suction operation; a second suction operation for sucking, through the suction port, ink from the print head and the suction cap; and a second discharge operation for discharging, through the discharge port, ink sucked during the second suction operation.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
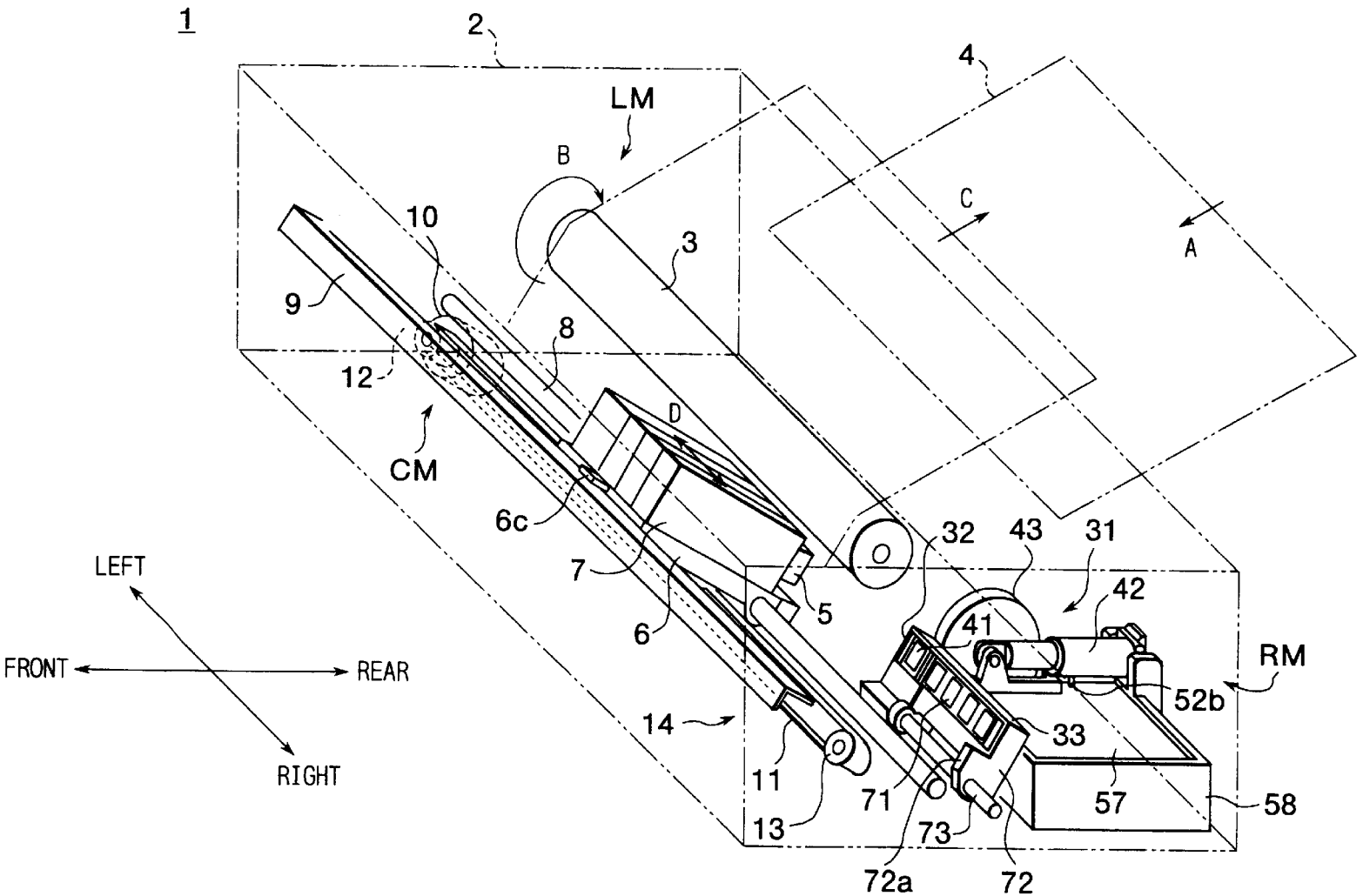
FIG. 1 is a perspective view partially in phantom showing an ink jet printer having a recovery device according to an embodiment of the present invention.

A recovery device of an ink jet printer according to a preferred embodiment of the present invention will be described while referring to the accompanying drawings wherein like parts and components are designated by the same reference numerals to avoid duplicating description.

FIG. 1 is a perspective view in partial phantom showing an ink jet printer 1 according to an embodiment of the present invention. The ink jet printer 1 includes: a sheet-feed mechanism LM having a cylindrical platen roller 3; a carriage 6 on which is detachably mounted an ink-jet recording head 5 and an ink cartridge 7 filled with ink to be supplied to the recording head 5; and a purge mechanism RM.

The sheet-feed mechanism LM is for transporting, in front of the ink-jet recording head 5, print sheets 4 supplied from a manual or cassette type sheet-feed unit (neither shown in the drawings). The platen roller 3 is rotatably supported on a printer frame 2 via a horizontally extending rotation shaft (not shown in the drawings). The sheet-feed mechanism LM includes a line feed (LF) motor 14 shown in FIG. 14 for driving the platen roller 3 to rotate for transporting the print sheets 4.

Although not shown in the drawings, a sheet-supply slit is formed at the rear edge of the printer frame 2 and a sheet-discharge slit is formed at the substantial center of the upper surface of the printer frame. Print sheets 4 are supplied in a direction indicated by an arrow A in FIG. 1 into the sheet supply slit. The thus-supplied print sheets 4 are transported in a direction indicated by an arrow B by rotation of the platen roller 3, and then discharged from the sheet-discharge slit in a direction indicated by an arrow C.

The recording head 5 and the ink cartridge 7 are detachably mounted on the carriage 6. The recording head 5 is an ink jet type recording head including nozzles through which ink droplets are ejected onto the print sheets 4 supported on the platen roller 3. According to the present embodiment, the recording head 5 is capable of ejecting, and the cartridge 7 is capable of supplying to the recording head 5, four different colored inks, that is, yellow, black, cyan, and magenta.

A carriage shaft 8 and a guide rail 9 are disposed extending parallel with the axial line of the platen roller 3. The carriage 6 is slidably supported on the carriage shaft 8 and guided by the guide rail 9 via an engagement portion 6*a*. A carriage mechanism CM having a timing belt 11 and timing pulleys 12, 13 is provided for driving the carriage 6 using drive force from a carriage return (CR) motor 10, such as a step motor or a DC motor. The timing belt 11 is connected to a portion of the carriage 6 and the timing pulley 12 is connected to the carriage return motor 10. Rotation of the carriage drive motor 10 drives the carriage mechanism CM to reciprocally move the carriage 6 in directions indicated by arrows D along the axial line of the platen roller 3. Accordingly the recording head 5 can be reciprocally driven in the directions indicated by the arrows D by reciprocal sliding motion of the carriage 6. The range at which the carriage 6 can be moved via the carriage mechanism CM is divided into a print area, which corresponds to the width of the platen roller 3, and a recovery area to the right of the print area.

Figure 2:
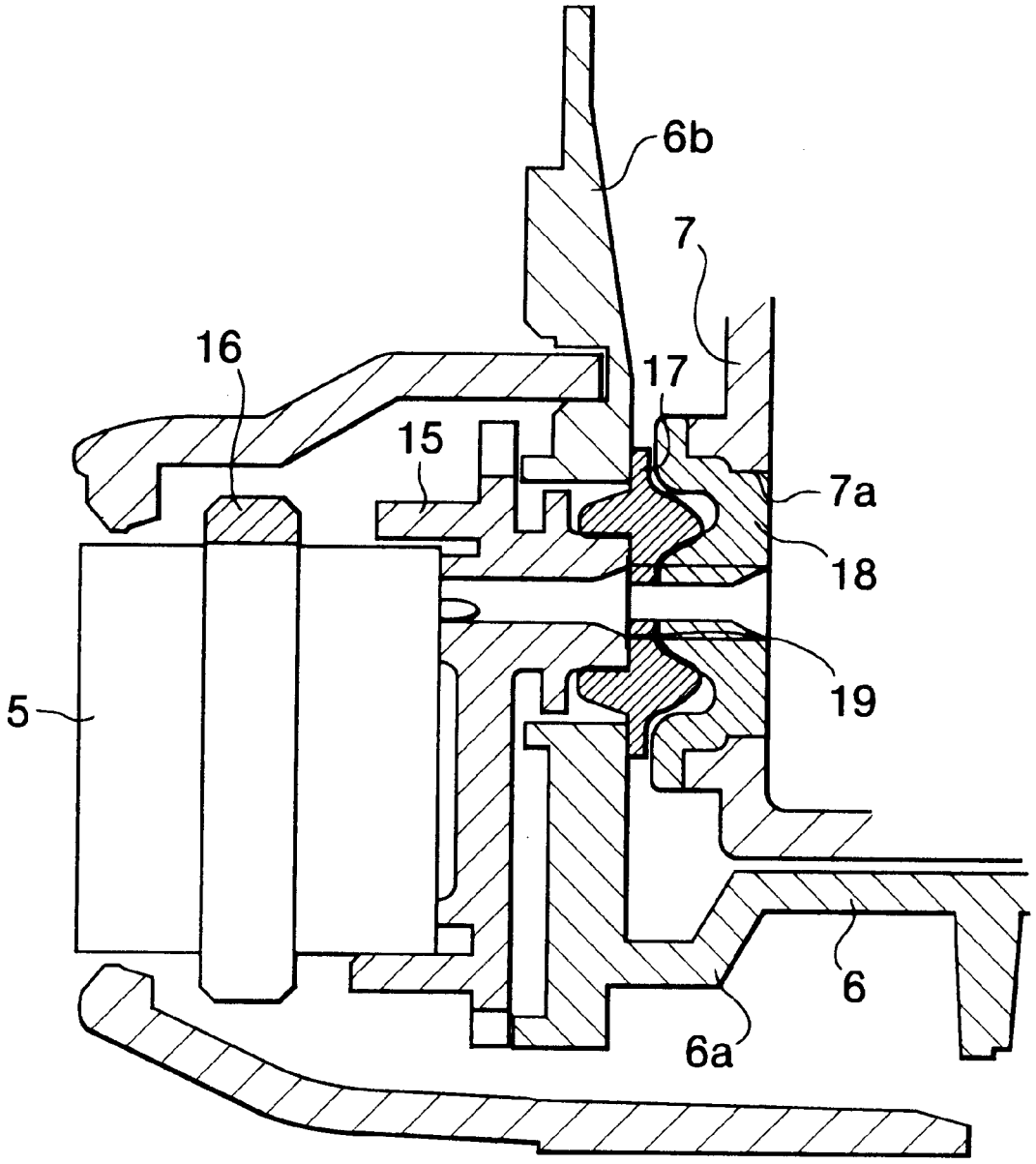
FIG. 2 is a cross-sectional view showing configuration for connecting a recording head with an ink cartridge of the ink jet printer.

As shown in FIG. 2, the carriage 6 has a cartridge mounting portion 6*a* for mounting the ink cartridge 7. The cartridge mounting portion 6*a* has a vertical wall portion 6*b* formed with a hole in which is disposed a joint member 17 and a manifold member 15 that are connected in fluid communication with each other. An adopter 18 fitted in an ink supply hole 7*a* of the ink cartridge 7 is disposed in connection with the joint member 17. The recording head 5 is supported by a head support member 16 in connection with the manifold member 15. In other words, the interior of the ink cartridge 7 and ejection channels of the recording head 5 are in fluid communication via a connection path formed by the manifold member 15 and the joint member 17. A net-shaped filter member 19 is provided between the adopter 18 and the filter member 19 to prevent foreign matter, such as dust, from traveling to the recording head 5 with ink supplied from the ink cartridge 7.

The purge mechanism RM is disposed in the recovery area and serves to correct poor or defective ejection of the recording head 5. Improper ejection can be caused by air bubbles generated at the interior of the recording head 5 during use, by ink droplets clinging to a nozzle surface of the recording head 5, or by drying of ink on the nozzle surface or in the nozzles of the nozzle surface. The purge mechanism RM is for returning the recording head 5 to a proper ejection condition when the recording head 5 does not properly eject ink for such reasons.

The purge mechanism RM includes: a suction cap 41; and a suction unit 31 having a suction pump 42, a wheel-shaped cam member 43 for controlling operations of the suction pump 42, and an ink disposal tank 58 filled with an absorbent material 57. The suction cap 41 is capable of moving between a protrusion position, wherein the suction cap 41 protrudes into a transport pathway of recording head 5, and a waiting position, wherein the suction cap 41 is retracted away from the transport pathway of the recording head 5. When the suction cap 41 covers and is in sealing contact with the nozzle surface of the recording head 5 while in the protrusion position, the suction unit 31 operates in a manner to be described later to generate a negative pressure in the suction cap 41 to suck ink from the recording head 5.

A wiper member 32 and a cap device 33 are disposed on either side of and adjacent to the suction unit 31. The wiper member 32 is disposed nearer to the recording area than is the suction unit 31. The cap device 33 is disposed further away from the recording area than is the suction unit 31. Said differently, the cap device 33 is disposed on the opposite side of the suction unit 31 with respect to the wiper member 32. Relative movement between the wiper member 32 and the recording head 5 causes the wiper member 32 to wipe the nozzle surface of the recording head 5. The cap device 33 covers the nozzle surface of the recording head 5 to prevent ink in the nozzles and on the nozzle surface from evaporating and drying out.

The cam member 43 serves as a drive unit used for driving the wiper member 32, the suction cap 41, and the suction pump 42. That is, the cam member 43 is connected to the wiper member 32, the suction cap 41, and the suction pump 42 so that when it is driven to rotate, the cam member 43 drives protruding and retracting movement of the wiper member 32, protruding and retracting movement of the suction cap 41, and suction and discharge operations of the suction pump 42.

Figure 3:
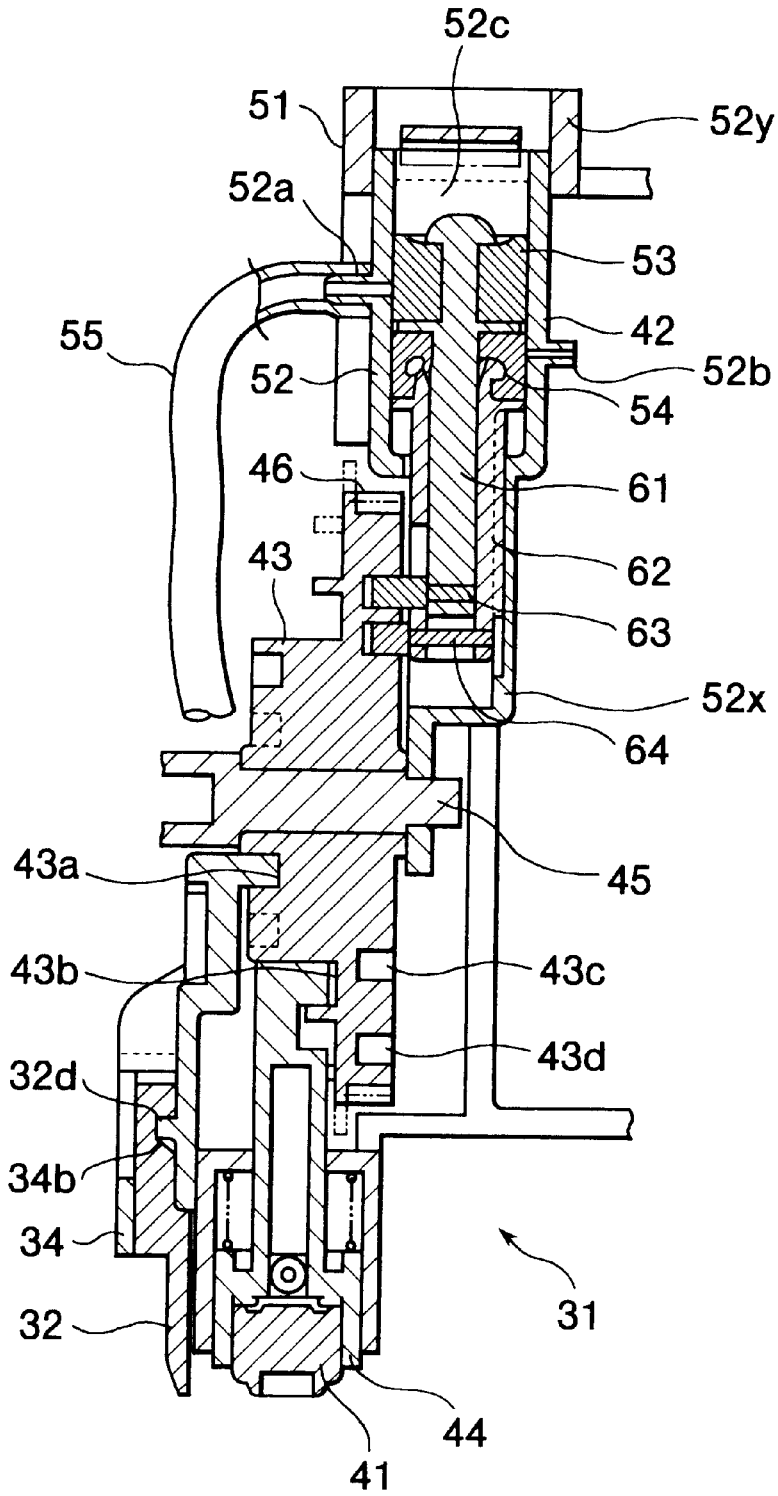
FIG. 3 is a cross-sectional view showing the recovery device including a wiper member, a suction cap, a suction pump, and a cam member.
Figure 4:
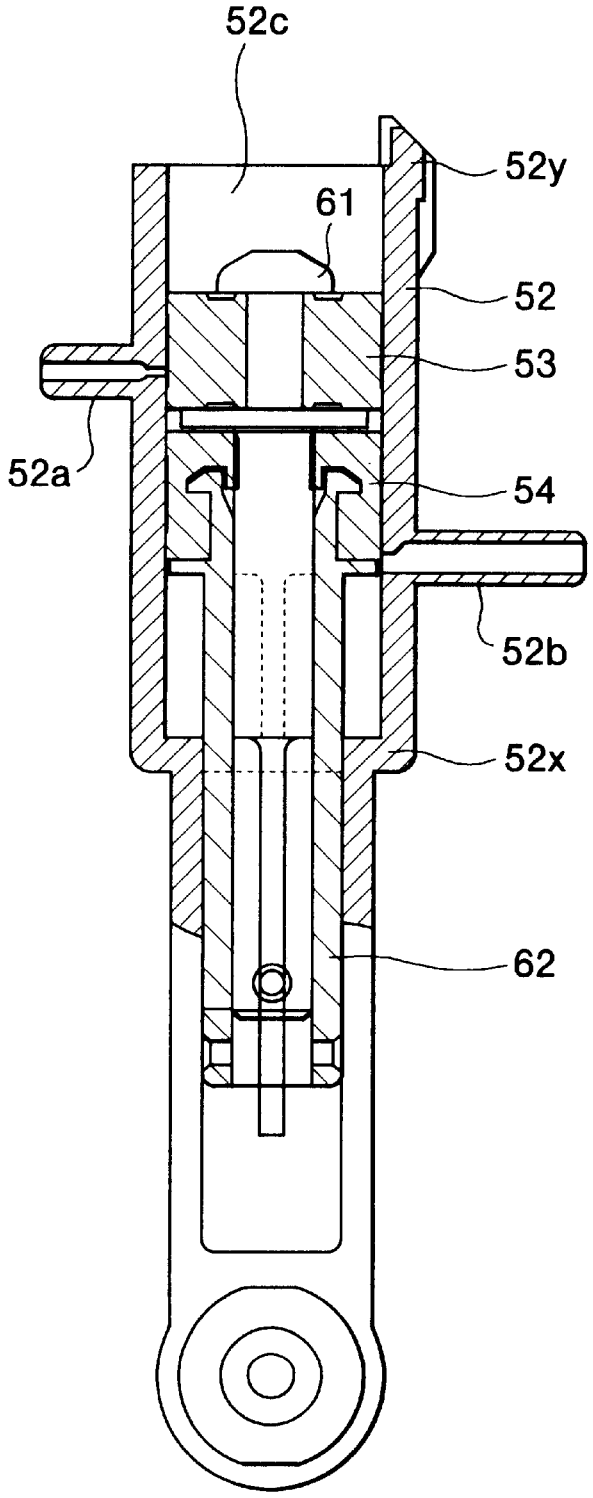
FIG. 4 is a cross-sectional view showing details of the suction pump including first and second piston members.

As shown in FIG. 3, the cam member 43 has a drive gear 46 formed from a single piece. The drive gear 46 is brought into and out of meshing engagement with another drive gear (not shown in the drawings) driven to rotate by the line feed motor 14 of the line feed mechanism LM. The cam member 43 is driven to rotate in a forward direction by the line feed motor 14. The cam member 43 is formed with a first through fourth cam grooves 43*a* to 43*d*, wherein the first and second cam grooves 43*a*, 43*b* are formed on one side surface of the cam member 43 and the third and fourth cam groove 43*c*, 43*d* are formed on an opposite surface of the cam member 43.

The wiper member 32 is supported by an end of a wiper holder 34. The wiper holder 34 includes cam follower portion 32*x* at an end thereof opposite the end supporting the wiper member 32. The cam follower portion 32*x* is slidingly engaged in the first cam groove 43*a* of the cam member 43 so that when the cam member 43 rotates, the wiper member 32 is controlled to move according to the shape of the first cam groove 43*a*. The wiper member 32 is controlled to move between a protruding position, wherein the wiper member 32 protrudes into the movement path of the recording head 5, and a waiting position, wherein the wiper member 32 is retracted away from the movement path of the recording head 5. In this way, the cam member 43 enables reciprocal movement of the wiper member 32 in a direction perpendicular to the movement path of the recording head 5. The wiper member 32 wipes the nozzle surface of the recording head 5 as the recording head 5 passes by the wiper member 32 while the wiper member 32 is in its protruding position.

The suction cap 41 is supported on an end of a cap holder 44. The cap holder 44 includes a cam follower portion 44*x* at an end thereof opposite the end supporting the suction cap 41. The cam follower portion is slidingly engaged in the second cam groove 43*b* of the cam member 43.

The suction pump 42 includes a cylindrical pump casing 52 that is fixedly attached on a frame member 51, and a pair of first and second piston members 53, 54 that are slidably fitted in the pump casing 52. The first and second piston members 53, 54 are capable of sliding within the pump casing 52 independently of each other. The pump casing 52 is formed with a suction port 52*a* and a discharge port 52*b* separated by a fixed distance in an axial direction of the pump casing 52. A suction tube 55 is provided for bringing the suction cap 41 into fluid connection with the suction port 52*a*. The discharge port 52*b* is in fluid communication with the waste ink tank 58. The pump casing 52 includes first and second ends 52*x*, 52*y* at opposite ends thereof. An open portion 52*c* is formed at the first end 52*y* for bringing the first end 52*y* side of the pump casing 52 into fluid communication with atmosphere. The first piston member 53 is disposed nearer to the open portion 52*c* than is the second piston member 54 and the second piston member 54 is disposed nearer the end 52*x* than is first piston member 53.

The first and second piston members 53, 54 are connected at one end to first and second drive members 61, 62, respectively. The first drive member 61 is slidably fitted in the second drive member 62. The first and second drive members 61, 62 are slidingly engaged in third and fourth cam grooves 43*c*, 43*d* respectively so that the first and second piston members 53, 54 are driven to move according to a distance between the first and second drive members 61, 62. When the first and second piston members 53, 54 are driven apart, a pump chamber 52*e* forms therebetween in the pump casing 52.

With this configuration, by driving the cam member 43 to rotate in a fixed timing, first a capping operation of the suction cap 41, then ink suction operations by the cam member 43, and finally a wiping operation for wiping the nozzle surface of the recording head 5 using the wiper member 32 are performed in this order. Ink sucked by the suction pump 42 is discharged through the discharge port 52*b* into the waste ink tank 58 whereupon it is absorbed by the absorption member 57 in the waste ink tank 58.

As shown in FIG. 1, the cap device 33 includes a protection cap 71, a casing 72 for supporting the protection cap 71, and a guide rod 73 extending in parallel with the axial line of the platen roller 3. The casing 72 is slidably mounted on the guide rod 73 so as to be pivotable around the guide rod 73. In other words, the guide rod 73 serves as a pivot axis of the casing 72. The casing 72 is formed with a protruding portion 72*a* that protrudes into the transport path of the carriage 6. When the carriage 6 moves from the recording area into the recovery area, the carriage 6 abuts against the protruding portion 72*a* so that the casing 72 slides integrally with the carriage 6 along the guide rod 73 to the right. Although not shown in the drawings, a slanting cam surface is provided for pivoting the casing 72 around the guide rod 73 when the casing 72 moves into the recovery area. When the casing 72 pivots around the guide rod 73, the protection cap 71 pivots toward the recording head 5 until the protection cap 71 contacts the nozzle surface of the recording head 5 and a capping operation is performed. Afterward, when the carriage 6 is driven to return to the recording area, the protection cap 71 will separate from the recording head 5 while moving with the carriage 6 toward the recording area. By the time the carriage 6 leaves the recovery area, the protection cap 71 will have returned to its initial position retracted away from the path traveled by the recording head 5.

Figure 5:
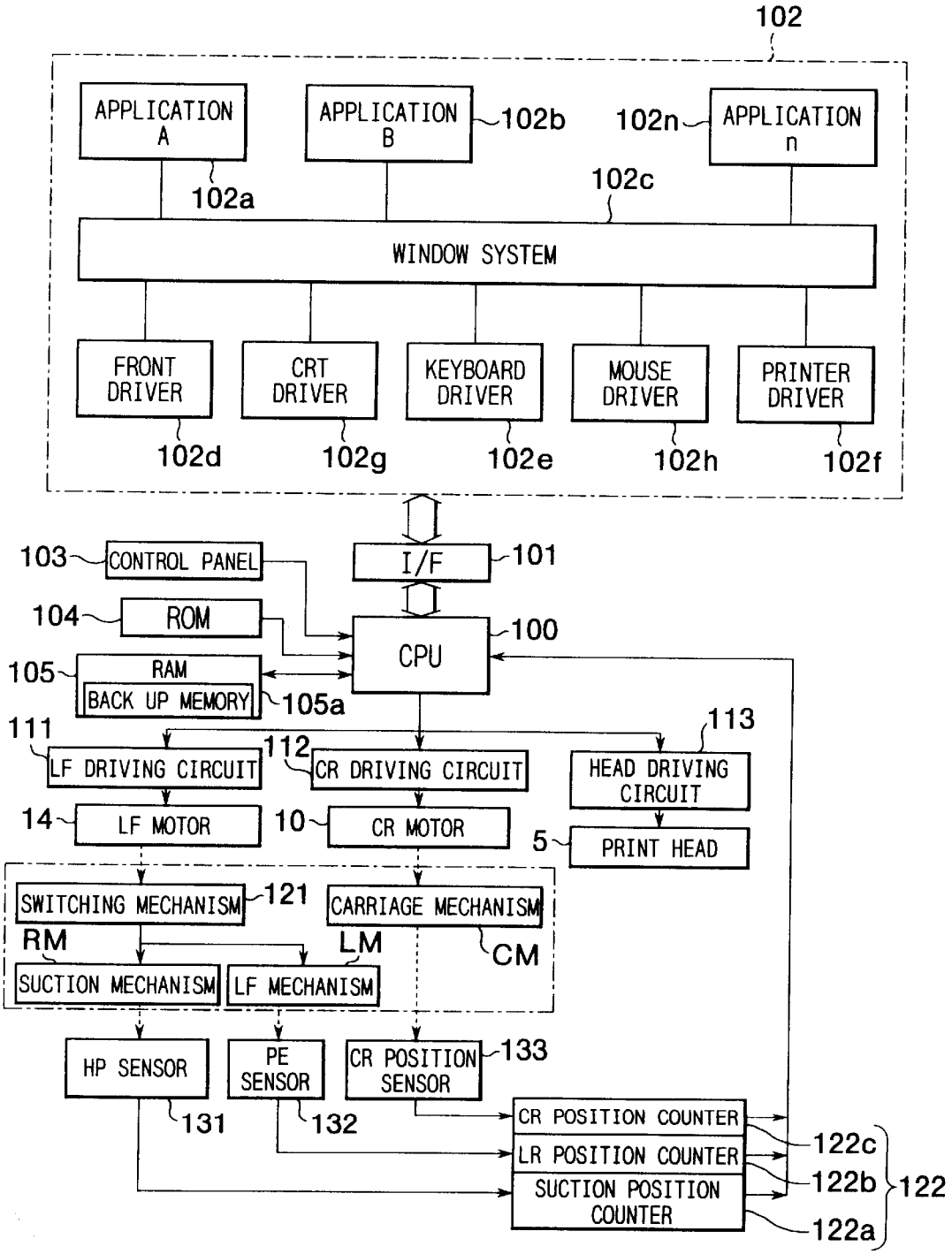
FIG. 5 is a block diagram showing a control system of the ink jet printer.

Next, an explanation will be provided for a control portion of the ink jet printer 1 while referring to the block diagram shown in FIG. 5. The control portion is centered on a central processing unit (CPU) 100. The central processing unit 100 is connected via an interface 101 to a host computer 102, such as a personal computer. The central processing unit 100 receives print commands from the host computer 102 and executes a variety of print operations accordingly.

The host computer 102 is typically driven by a windows system 102*c*. The windows system 102*c* is capable of operating a variety of drive applications A, B, to n, which are referred to in FIG. 5 as 102*a*, 102*b*, to 102*n*, respectively, and a variety of drivers such as a font driver 102*d*, a cathode ray tube (CRT) driver 103*g*, a keyboard driver 102*e*, a mouse driver 102*h*, and a printer driver 102*f*. When the printing operation is performed using the printer while these applications are running, the host computer 102 uses the printer driver 102*f* to prepare output data on images in a form usable by the ink jet printer 1.

The central processing unit 100 is connected to an operation panel 103, a ROM 104, and a RAM 105. The operation panel 103 is used to input various parameters, such as the size of the printing medium, and is used to display the inputted parameters. The ROM 104 stores various programs for controlling the ink jet printer 1. The RAM 105 is for temporarily storing print data transmitted from the host computer 102 and for temporarily storing a variety of figures and values needed for controlling the ink jet printer 1. The RAM 105 includes a buffer memory 105*a*.

The central processing unit 100 is further connected to a line feed drive circuit 111 for driving a line feed (LF) motor 14, a carriage return (CR) drive circuit 112 for driving the carriage drive motor 10, and a head drive circuit 113 for driving the recording head 5.

The line feed motor 14 is connected to a purge mechanism RM and a line feed (LF) mechanism LM via a switching mechanism 121. The switching mechanism 121 enables the line feed motor 14 to selectively drive either of the purge mechanism RM or the line feed mechanism LM. In other words, the switching mechanism 121 selectively transmits the drive force of the line feed motor 14 to either the purge mechanism RM or the line feed mechanism LM to drive the corresponding mechanism. The switching mechanism 121 is switched by movement of the carriage 6 as moved by the carriage mechanism CM. The switching mechanism 121 switches to transmit the drive force from the line feed motor 14 only to the purge mechanism RM during purge operations, whereupon the cam member 43 is drivingly rotated at a predetermined timing so that the purge operations are performed.

The central processing unit 100, the switching mechanism 121, and the cam member 43 operate in cooperation to control the suction pump 42 to sequentially perform a first and second suction and discharge operations. During the first suction operation, the piston members 53, 54 separate slightly to slightly increase volume of the pump chamber 53*e*. As a result, a small negative pressure develops in the pump chamber 53*e* that sucks ink from the recording head 5 into the suction cap 41 and into the suction tube 55 that connects the suction cap 41 to the suction pump 42. After the first ink suction operation is completed, the first discharge operation is performed so that any ink sucked into the pump chamber 53*e* is discharged by controlling the first and second piston members 53, 54 to reduce the volume of the pump chamber 52*e* to its minimum. Next, the second suction and discharge operations is performed. During the second suction operation, the piston members 53, 54 are separated from each other to greatly increase the volume of the pump chamber 53*e* to produce a relatively large negative pressure in the pump chamber 52*e*. This relatively large negative pressure sucks ink from the recording head 5 into the pump chamber 52*e*. Afterward, during the second discharge operation, the piston members 53, 54 are brought together again to reduce the volume of the pump chamber 52*e* to discharge the ink therefrom.

As will be described in more detail below, the purge mechanism RM includes a purge home position (HP) sensor 131, the sheet-feed mechanism LM includes a page end (PE) sensor 132, and the carriage mechanism CM includes a carriage return (CR) sensor 133. Each of the sensors 131, 132, and 133 are connected to a corresponding counter of a counter group 122 so that signals outputted by the sensors 131, 132, and 133 are inputted to the central processing unit 100 via the counter group 122.

That is, the purge home position (HP) sensor 131 of the purge mechanism RM is connected to a purge position counter 122*a* of the counter group 122. The purge home position sensor 131 indicates to the purge position counter 122*a* when the suction pump 42 reaches a home position. This signal from the purge home position sensor 131 serves as a standard reference for purge operations performed by the purge mechanism RM.

The page sensor 132 of the line feed mechanism LM is connected to a line feed position counter 122*b* of the counter group 122. The page sensor 132 generates a signal each time an edge of a newly supplied print sheet 4 passes by the page sensor 132. The page sensor 132 outputs the signal to the line feed position counter 122*b* to indicate that a new print sheet 4 has been supplied. The signal from the page sensor 132 is used as a standard reference to indicate when printing is to be started with respect to a sheet feed direction, which is perpendicular to the direction of arrows D shown in FIG. 1.

The carriage return position sensor 133 of the carriage mechanism CM is connected to a carriage return position counter 122*c* of the counter group 122. The carriage return position sensor 133 detects the carriage 6 based on the number of drive pulses outputted to the carriage drive motor 10, which is for driving the carriage 6. The carriage return position sensor 133 indicates the position of the carriage 6 to the carriage return position counter 122*c*. Positional information derived in this manner for the carriage 6 serves as a standard reference for positioning the carriage 6 in a proper position in the direction indicated by the arrows D. The positional information also serves as a basis for determining whether or not a new print sheet 4 can be supplied to, and whether or not a printed print sheet 4 can be discharged from, the ink jet printer 1.

Next, an explanation will be provided for operations of the ink jet printer 1 configured as described above. First, a recording operation will be described. Normally, the recording head 5 is positioned in its waiting position in the recovery area while covered with the protection cap 71. A recording operation is started when recording data is inputted.

When recording data is inputted, a print sheet 4 is supplied to the platen roller 3. The carriage drive motor is driven to move the recording head 5 from its waiting position confrontation with the protection cap 71 into a recording start position in confrontation with the platen roller 3. While the recording head 5 is being moved toward the recording start position, the protection cap 71 is retracted away from the recording head 5. Then, to print characters and other images on the print sheet 4, the recording head 5 is controlled to eject ink based on the inputted recording data while the carriage drive motor 10 is driven to reciprocally move the carriage 6 and the recording head 5 across the recording area.

The recording operation is completed once all recording data stored in the recording data memory of the ROM 104 has been completely recorded. Once the recording operation has been completed, the recording head 5 is moved from where recording was completed back to the waiting position. When the recording head 5 reaches the waiting position, the protection cap 71 will cover the recording head 5 so that ink in the nozzles of the recording head 5 will not dry out while the recording head 5 is not being used.

Next, purge operations will be described. When the user determines that a purge operation is required, he or she inputs a purge command by operating a purge switch on the operation panel 103. The user operates the purge switch when he or she judges that ink needs to be sucked from the recording head 5 to correct defective ink ejection, after an ink cartridge has been replaced, or as a part of routine maintenance performed on the recording head 5.

When the purge command is inputted, the purge mechanism RM will enter its purge mode and a suction operation program stored in the ROM 104 will be started. During the purge mode of the purge mechanism RM, the carriage drive motor 10 is driven to drive the carriage mechanism CM so that the recording head 5 moves from the waiting position to a predetermined purge position in confrontation with the suction cap 41 where purging operation can take place. When the recording head 5 is in its purge position, the switching mechanism 121 switches to a condition for transmitting drive force from the line feed motor 14 to the purge mechanism RM. At this time, the line feed motor 14 is driven to rotate by an amount sufficient to rotate the cam member 43 a single time. As will be described below, a single rotation of the cam member 43 moves the suction cap 41 and the wiper member 32 at a predetermined timing toward and away from the recording head and also performs suction and discharge operations using the suction pump 42. It should be noted that movement of the suction cap 41 toward and away from the recording head 5 and the suction and discharge operations are performed while the recording head 5 is in the purge position and movement of the wiper member 32 is performed while the recording head 5 is moving toward the printing area.

The suction operation includes a nozzle suction operation, wherein ink is sucked form the recording head 5 by the suction pump 42 while the suction cap 41 is in sealing contact with the nozzle surface, and an idle suction operation, wherein ink is sucked from within the suction cap 41 by the suction pump 42 while the suction cap 41 is separated from the nozzle surface.

Here, details of the purge operation of the ink jet printer 1 will be described while referring to FIGS. 6 (*a*) to 6 (*l*) and 7. When the ink jet printer 1 performs the purge operation, the central processing unit 100 drives the carriage drive motor 10 via the carriage drive circuit 112 to move the recording head 5 into the purge position in confrontation with the suction cap 41. The CPU 100 then controls the cam member 43 to operate the suction cap 41, the suction pump 42, and the like to perform a series of purge operations described below for returning the recording head 5 to ink ejecting condition.

Figure 6:
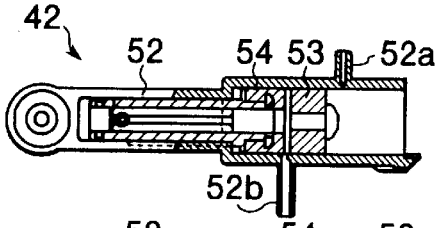
FIGS. 6 (*a*) to 6 (*l*) are cross-sectional views showing the suction pump during different stages of a purge operation.
Figure 6:
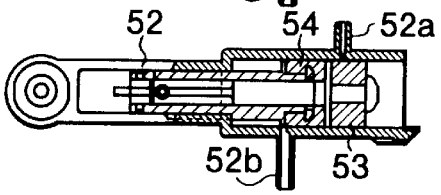
Figure 6:
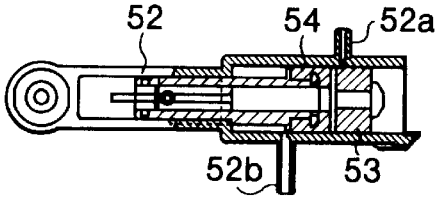
Figure 6:
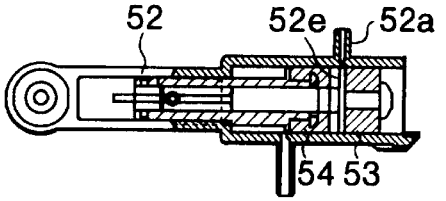
Figure 6:
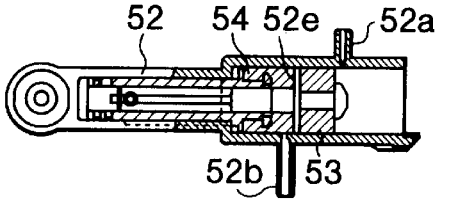
Figure 6:
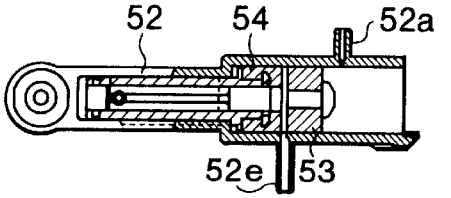
Figure 6:
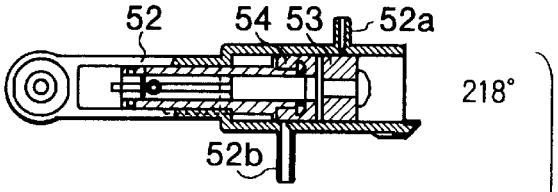
Figure 6:
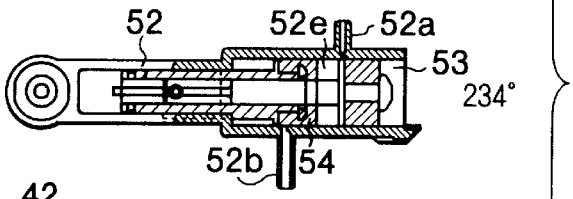
Figure 6:
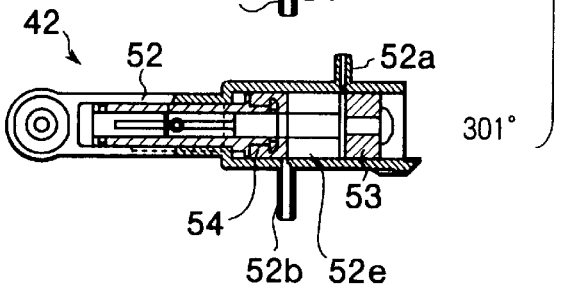
Figure 6:
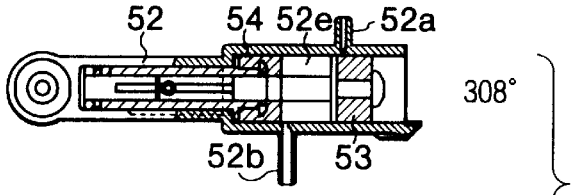
Figure 6:
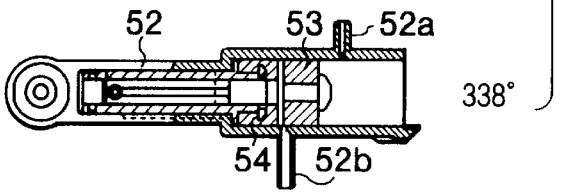
Figure 6:
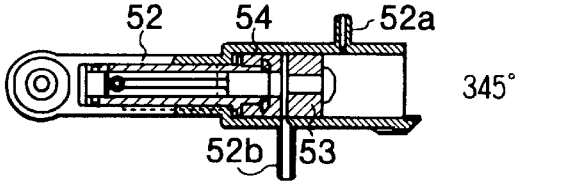
Figure 7:
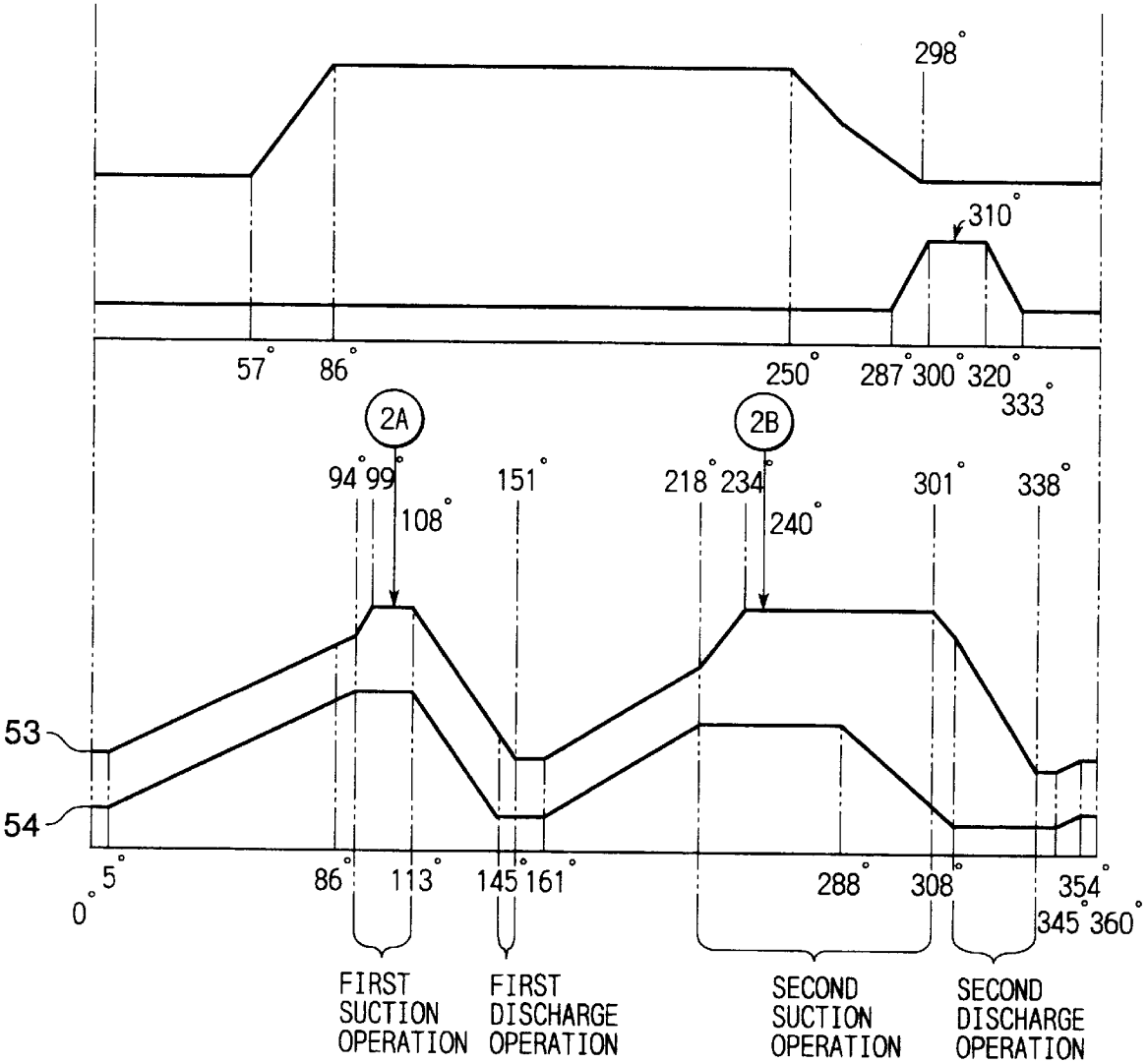
FIG. 7 is a timing chart showing positional changes of the suction cap, the wiper blade, the first piston member, and the second piston member with respect to rotational angle of the cam member during the purge operation.

As shown in FIG. 6 (*a*) and FIG. 7, when the cam member 43 is oriented in the vicinity of a 0° rotational angle, both piston members 53, 54 of the suction pump 42 are in intimate contact with each other with the boundary between the two piston members 53, 54 aligned near the discharge port 52*b*. At this time, as shown in FIG. 7, the suction cap 41 is in the waiting position.

As shown in FIG. 6 (*b*) and FIG. 7, when the cam member 43 is first driven to rotate, that is, from when the rotational angle of the cam member 43 is about 6°, then the piston members 53, 54 move integrally with each other toward the open portion 52*c*. Speed of the two piston members 53, 54 increases slightly when a rotational angle of the cam member 43 is about 86°. As shown in FIG. 7, starting from when the rotational angle of the cam member 43 is about 57°, the suction cap 41 gradually moves its waiting position into the movement path of the recording head 5. When the rotational angle of the cam member 43 is about 86°, the suction cap 41 will be in sealing contact with the nozzle surface of the recording head 5.

As shown in FIG. 6 (*c*) and FIG. 7, when the rotational angle of the cam member 43 is about 94°, the second piston member 54 will stop moving while the first piston member 53 continues moving at an increased speed so that volume of the pump chamber 52*e* increases. This is the start of the first suction operation.

As shown in FIG. 6 (*d*) and FIG. 7, when the rotational angle of the cam member 43 rotates to 99°, then movement of the first piston member 53 stops at a position wherein the pump chamber 52*e* is in fluid communication with the suction port 52*a*. When the cam member 43 rotates to a rotational angle of 108°, rotation of the cam member 43 is temporarily stopped, as indicated by 2A in FIG. 7, for a fixed period of, for example, 3 seconds. During this period, relative positions of the first and the second piston members 53, 54 are maintained. The first suction operation generates a small negative pressure in the pump chamber 52*e* so that air is removed from the suction cap 41 and the suction tube 55, and replaced with ink drawn from the recording head 5. In other words, the first suction operation fills the suction cap 41 and the suction tube 55 with ink, ideally up to the suction pump 42 although some ink may enter the pump chamber 52*e* without causing problems.

After the fixed period has elapsed, rotation of the cam member 43 is again started. When rotational angle of the cam member 43 reaches the vicinity of 113°, then the first suction operation is completed. The piston members 53, 54 are moved integrally together toward the discharge port 52*b* while maintaining the volume of the pump chamber 52*e*.

As shown in FIG. 6 (*e*) and FIG. 7, once rotational angle of the cam member 43 reaches near 145°, the pump chamber 52*e* is brought into fluid communication with the discharge port 52*b*. At this time, the second piston member 54 stops moving. However, the first piston member 53 continues to move so that the volume of the pump chamber 52*e*is reduced and the air and any ink sucked into the pump chamber 52*e* during the first suction operation is discharged from the discharge port 52*b*. Here, the first discharge operation is performed.

As shown in FIG. 6 (*f*) and FIG. 7, when the cam member 43 rotates to a rotational angle of 151°, the first piston member 53 will have moved into abutment contact with the second piston member 54. As a result, ink will have been discharged from the pump chamber 52*e* through the discharge port 52*b* and the volume of the pump chamber 52*e* will be at minimum. This ends the first discharge operation. Relative positions of the first and the second piston members 53, 54 are maintained until the cam member 43 rotates to a rotational angle of about 161°.

It should be noted that only air and any ink filling the pump chamber 52*e* is discharged during the first discharge operation. That is, because the suction cap 41 is in sealing contact with the recording head 5, atmosphere will be unable to enter through the suction cap 41 during the first discharge operation. Therefore, even though the suction port 52*a* is in fluid communication with the interior of the pump casing 52 during the first discharge operation, ink filling the suction cap 41 and the suction tube 55 will remain in the suction cap 41 and not flow through the suction port 52*a* into the pump casing 52.

As shown in FIG. 6 (*g*) and FIG. 7, when the cam member 43 rotates from a rotational angle of 161° to 218°, the piston members 53, 54 move integrally with each other toward the suction port 52*a*. When the cam member 43 rotates to a rotational angle of 218°, the second piston member 54 stops while the first piston member 53 continues to move at an increased speed so that volume of the pump chamber 52*e* increases. This is the start of the second suction operation.

As shown in FIG. 6 (*h*) and FIG. 7, when the rotational angle of the cam member 43 reaches the vicinity of 234°, the first piston member 53 is moved into a position so that suction port 52*a* is brought into fluid communication with the pump chamber 52*e*. The second suction operation has a larger suction force than the first suction operation and so sucks ink from the recording head 5 in a greater volume that during the first suction operation so that the ejection condition of the recording head 5 can be returned to a good condition.

When the cam member 43 is rotated to a rotational angle in the vicinity of 240° as indicated by a position 2B in FIG. 7, rotation of the cam member 43 is again stopped, this time for a longer fixed period of, for example, 5 seconds. After the longer fixed period elapses, rotation of the cam member 43 is continued. Relative positions of the first and second piston members 53, 54 are maintained until the cam member 43 rotates to a rotational angle of about 268°.

With respect to the suction cap 41, the suction cap 41 is maintained in sealing contact with the nozzle surface of the recording head 5 until the cam member 43 rotates to the vicinity of 250°, that is, from when the cam member 43 rotates from a rotational angle of 86°. When the cam member 43 rotates to a rotational angle in the vicinity of 250°, the suction cap 41 is separated from the nozzle surface of the recording head 5. However, because the second suction operation is being performed at this time, ink filling the suction cap 41 and the suction tube 55 is sucked out in what is referred to as an idle suction operation. The suction cap 41 gradually retracts away from the nozzle surface of the recording head 5 from when the cam member 43 rotates from a 250° to a 268° rotational angle. By the time the cam member 43 rotates to a rotational angle of 298°, the suction cap 41 is completely retracted into its initial waiting position.

As shown in FIG. 6 (*i*) and FIG. 7, when the cam member 43 rotates from a rotational angle of 268° to 301°, the first piston member 53 is retained in a position wherein the suction port 52*a* is maintained in fluid communication with the pump chamber 52*e* and the second piston member 54 is moved toward the discharge port 52*b* until directly before the discharge port 52*b* is brought into fluid communication with the pump chamber 52*e*. By the time the cam member 43 rotates to a rotational angle of 301°, the volume of the pump chamber 52*e* is increased to its maximum size. This ends the second suction operation.

As shown in FIG. 6 (*j*) and FIG. 7, while the cam member 43 rotates from a rotational angle of 301° to 308°, the first and second piston members 53, 54 move integrally toward the end 52*x*. That is, the first piston member 53 moves to cover the suction port 52*a* to block fluid communication between the pump chamber 52*e* and the suction port 52*a* and, at the same time, the second piston member 54 moves to uncover the discharge port 52*b* and bring the pump chamber 52*e* into fluid communication with the discharge port 52*b*. When a rotational angle of the cam member 43 is in the vicinity of 308°, the second piston member 54 has moved to bring the discharge port 52*b* into fluid communication with the pump chamber 52*e* and stops. This starts the second discharge operation.

As shown in FIG. 6 (*k*) and FIG. 7, the first piston member 53 continues moving toward the discharge port 52*b* until rotational angle of the cam member 43 is in the vicinity of 338°. This reduces the volume of the pump chamber 52*e* so that the second discharge operation discharges ink from within the pump chamber 52*e* into the waste ink tank 58. Once rotational angle of the cam member 43 reaches 338° the second discharge operation is completed.

As shown in FIG. 6 (*l*) and FIG. 7, the positions of the piston members 53, 54 do not change after the second discharge operation is completed while the cam member 43 rotates between a rotational angle of 338° to 345° From when the rotational angle of the cam member 43 is between 345° and 354°, both the piston members 53, 54 move slightly toward the suction port 52*a* to return to their initial positions. This condition is maintained from when the cam member 43 rotates from 454° to 360°, that is, to 0°.

It should be noted that as shown in FIG. 7, the wiper member 32 remains in its retracted position from when rotational angle of the cam member 43 is between 0° and 287°. However, when the cam member 43 rotates from a rotational angle of 287° to 300°, the wiper member 32 is gradually moved into the movement path of the recording head 5. When the cam member 43 rotates between a rotational angle of 300° to 320°, the wiper member 32 protrudes into the movement path of the recording head 5 from and wipes the nozzle surface of the recording head 5 as the recording head 5 travels from the recovery area toward the recording area. Actual wiping is performed when the rotational angle of the cam member 43 is 310°. When the cam member 43 rotates a rotational angle of 320° to 333°, the wiper member 32 then draws back away form the movement path of the recording head 5 into its waiting position, where it remains until the cam member 43 rotates to a rotational angle of 360°.

With this configuration, the suction pump 42 performs a first ink suction and discharge operations having a small negative pressure for sucking air out from the suction cap 41 and the suction tube 55 and for filling the suction cap 41 and the suction tube 55 with ink. Then during the first discharge operation the volume of the pump chamber 52 is reduced to a minimum as shown in FIG. 6 (*f*). Afterward, the suction pump 42 performs the second suction operation. Because the second suction operation is started after the pump chamber has been reduced to a minimum volume, the amount of ink sucked by the predetermined stroke of the first piston member 53 will be the maximum possible allowed by the predetermined stroke.

Were a single suction operation performed instead of the first and second suction operations, the single operation would start with air filling the suction cap and the channel connecting the suction cap with the suction pump. To suck ink from the recording head in an amount sufficient to fill the suction cap, the channel, and the pump chamber in a single suction operation, the piston members would need to be moved in a stroke substantially equal to the stroke required to perform the first suction operation and the stroke required to perform the second suction operation. The burden placed on the suction pump would be increased. Further, the pump casing of the suction pump would need to be formed in a size large enough so the pistons could move by such a large stroke. Also, the cam member 43 would need to formed large enough to separate the pistons sufficiently to produce the large stroke.

However, according to the present embodiment, the second suction operation is performed with ink filling the suction cap 41 and the suction tube 55 and is started after the volume of the pump chamber 52*e* is returned to its minimum volume. As a result, only a relatively small stroke is required to suck a predetermined volume of ink from the recording head 5. As result, the pump itself including the pump casing and the cam member 43 can be formed in a smaller and more compact shape. Further, the burden placed on the suction pump is reduced.

As described with reference to FIG. 2, the interior of the ink cartridge 7 and ejection channels of the recording head 5 are in fluid communication via a connection path formed by the manifold member 15 and the joint member 17. There will be some situations when the ejection channels of the recording head 5, the connection path, or both will be filled with air instead of ink. For example, ejection channels in a new unused recording head are filled with air. When a new ink cartridge is mounted to a new recording head, the connection path from the ink cartridge to the nozzles of the recording head are also filled with air. When a used ink cartridge is replaced with a new one, although the recording head may be filled with ink, the connection path from the ink cartridge to the recording head will be filled with air.

Ink can also be completely drawn out of the recording head and the connection path by purge operations. For example, when the user performs purge operations when only a small amount of ink remains in the ink cartridge, then all ink remaining in the ink cartridge, and consequently the connection path and the ejection channels of the recording head, can be sucked out and replaced with air. This situation can arise when a user assumes that poor print quality, which is actually caused by lack of ink in the ink cartridge, is being caused by clogged nozzles. When the user operates the suction unit in an attempt to clear up the nozzles, all remaining ink will be sucked out of the ink cartridge, the connection passage, and the recording head. Further, a user can intentionally perform purge operations after removing an empty ink cartridge in order to remove all ink from the connecting channels and ejection channels. In this situation also, air will be drawn into the recording head and the connecting channels.

According to the present embodiment, the first suction operation gently fills the suction cap 41 and the suction tube 55 with ink before the second suction operation vigorously draws the ink from the recording head 5. Were the second operation to be performed without performing the first suction operation, the great suction force of the second operation would draw ink from the ink cartridge 7 into the connection path and into the ink channels of the recording head 5 with great force so that the flowing ink will collide with walls of the ink channels and the connection path and mix with air in a turbulent manner. This would form air bubbles in the ink of the ink channels A filter member, such as the filter member 19, disposed between the recording head and the ink cartridge can be a source of great turbulence in ink flowing from the recording head to the ink cartridge. However, according to the present embodiment, the first suction operation which has a small negative pressure draws ink gently past the filter member 19 before the second ink suction operation is performed. Therefore, regardless of whether or not the filter member 19 is provided, purge operations can be performed without fear of bubbles forming in the ink. Therefore, the second suction operation can be performed with a great suction force without bubbles forming in the ink of the recording head 5.

While the invention has been described in detail with reference to specific embodiments thereof, it would be apparent to those skilled in the art that various changes and modifications may be made therein without departing from the spirit of the invention, the scope of which is defined by the attached claims.

For example, in the above-described embodiment, the first and second suction operations are performed to generate different negative pressures. However, the first and second suction operations can be performed to generate the same negative pressure. As long as an operation is performed for increasing the volume of the pump chamber 52 so that ink fills and is maintained in the suction cap 41 and the suction tube 55 and then, sequentially with this, another operation is performed for reducing the volume of the pump chamber 52*e* and again increasing the volume of the pump chamber 52*e*, purge operations for purging foreign matter from the recording head can be efficiently performed from a condition when ink fills the suction cap 41 and the suction tube 55.

Also, the embodiment describe that the first suction operation fills the suction cap 41 and the suction tube 55 with ink. However, even if the first suction operation only partially fills the suction tube 55 or only partially fills the suction cap 41, the burden placed on the suction pump 42 will be reduced by that amount during the second suction operation so that the suction pump 42 will be more efficient.

Although the embodiment describes that the volume of the pump chamber 52*e* is reduced to a minimum during the first discharge operation, the volume of the pump chamber 52*e* need only be partially reduced during the first discharge operation.

What is claimed is:

1. A recovery unit used in an ink jet printer having a recording head with a nozzle surface formed with nozzles that eject ink to record on a recording medium, the recovery unit being for returning the recording head to a proper ejecting condition, the recovery unit comprising:

a suction cap capable of covering the nozzle surface of the recording head;

a suction pump connected to the suction cap and that in each separate recovery operation sucks, through the suction cap, ink from the nozzles formed in the nozzle surface; and a suction control unit that controls the suction pump to perform two suction operations and two discharge operations in each separate recovery operation in order of: 1) a first ink suction operation, 2) a first discharge operation, 3) a second ink suction operation, then 4) a second discharge operation, the suction control unit controlling the suction pump to generate a greater negative pressure during the second ink suction operation than during the first ink suction operation, wherein the two suction operations and the two discharge operations are performed in a cycle, and the suction control unit includes a disk-shaped cam member that rotates to drive the suction pump to sequentially perform the first ink suction operation, the first discharge operation, the second ink suction operation, and the second discharge operation, by a single cycle's worth of rotation of the cam member.

2. A recovery unit as claimed in claim 1, wherein the suction pump and the suction cap are connected in fluid communication by a channel, the suction control unit controlling the suction pump to suck ink to fill the suction cap and the channel during the first ink suction operation.

3. A recovery unit as claimed in claim 2, wherein:

the suction pump includes:

a cylindrical pump casing having a suction port in fluid communication with the suction cap via the channel and a discharge port for discharging ink sucked from the suction cap; and a first and second piston members slidably disposed in the cylindrical pump casing so as to define therebetween a pump chamber with volume that varies with relative position of the first and second piston members; and the suction control unit controls the first and second piston members so that volume of the pump chamber is greater during the second ink suction operation than during the first ink suction operation.

4. A recovery unit as claimed in claim 3, wherein the suction control unit includes a disk-shaped cam member rotating about an axis and formed with grooves that surround the axis, the first and second piston members being engaged in the grooves so that rotation of the cam member drives and controls relative position of the first and second piston members according to shape of the grooves.

5. A recovery unit as claimed in claim 4, wherein the grooves are shaped so that a single rotation of the cam member drives and controls the first and second piston members to sequentially perform the first suction operation, the first discharge operation, the second suction operation, and the second discharge operation.

6. A recovery unit as claimed in claim 2, wherein the suction control unit controls the suction pump to discharge during the first discharge operation all air and ink sucked during the first ink suction operation while maintaining the ink in the suction cap and the channel.

7. A recovery unit as claimed in claim 6, wherein the suction control unit controls the first and second piston members to decrease volume of the pump chamber to a minimum volume during the first discharge operation before starting the second ink suction operation.

8. A recovery unit as claimed in claim 6, wherein after the suction control unit controls the suction pump to discharge during the first discharge operation, the suction control unit controls the suction pump during the second ink suction operation to suck ink from the nozzles, the suction cap and the channel.

9. A recovery unit as claimed in claim 1, wherein: the suction pump includes:

a cylindrical pump casing having a suction port in fluid communication with the suction cap and a discharge port; and a first and second piston members slidably disposed in the cylindrical pump casing so as to define therebetween a pump chamber with volume that varies with relative position of the first and second piston members; and the suction control unit controls the first and second piston members so that volume of the pump chamber is greater during the second ink suction operation than during the first ink suction operation.

10. A recovery unit as claimed in claim 1, wherein the suction control unit includes a disk-shaped cam member that rotates to drive the suction pump to sequentially perform the first ink suction operation, the first discharge operation, the second ink suction operation, and the second discharge operation, by the single cycle's worth of rotation of the cam member.

11. A recovery unit of an ink jet printer having a recording head with a nozzle surface formed with nozzles that eject ink to record on a recording medium, the recovery unit being for returning the recording head to a proper ejecting condition, the recovery unit comprising:

a suction cap capable of sealingly covering the nozzle surface of the recording head;

a suction pump in fluid communication with the suction cap through a channel, the suction pump having a variable volume pump chamber that enables the suction pump to suck ink from the nozzles through the suction cap; and a suction control unit that controls the suction pump to sequentially:

bring the suction cap into sealed contact with the nozzle surface of the recording head;

increase volume of the pump chamber a first time to draw ink into the suction cap and the channel;

decrease volume of the pump chamber while maintaining ink in the suction cap and the channel; and increase volume of the pump chamber a second time to suck ink from the nozzles, the suction cap, and the channel.

12. A recovery unit as claimed in claim 11, wherein the volume of the pump chamber is increased more the second time than when increased the first time.

13. A recovery unit as claimed in claim 11, wherein increasing volume of the pump chamber the second time generates a greater negative pressure in the pump chamber than when the volume of the pump chamber is increased the first time.

14. A recovery unit of an ink jet printer having a recording head with a nozzle surface formed with nozzles that eject ink to record on a recording medium, the recovery unit being for returning the recording head of to a proper ejecting condition, the recovery unit comprising:

a suction cap capable of sealingly covering the nozzle surface of the recording head;

a suction pump in fluid communication with the suction cap, the suction pump including:

a cylindrical pump casing having a suction port in fluid communication with the suction cap and a discharge port; and a first and second piston members slidably disposed in the cylindrical pump casing so as to define therebetween a pump chamber with volume that varies with relative position of the first and second piston members; and a disk-shaped cam member rotatable about an axis and formed with grooves that surround the axis, the first and second piston members being engaged in the grooves, the grooves being shaped so that a single rotation of the cam member drives and controls the first and second piston members to sequentially perform:

a first suction operation for sucking, through the suction port, air from the suction cap and ink from the print head;

a first discharge operation for discharging, through the discharge port, at least air sucked during the first suction operation;

a second suction operation for sucking, through the suction port, ink from the print head and the suction cap; and a second discharge operation for discharging, through the discharge port, ink sucked during the second suction operation.

* * * * *